US010127811B2

(12) United States Patent
Xu et al.

(10) Patent No.: US 10,127,811 B2
(45) Date of Patent: Nov. 13, 2018

(54) METHOD, APPARATUS AND COMPUTER PROGRAM PRODUCT FOR COMPREHENSIVE MANAGEMENT OF SIGNAL PHASE AND TIMING OF TRAFFIC LIGHTS

(71) Applicant: HERE Global B.V., Eindhoven (NL)

(72) Inventors: Jingwei Xu, Buffalo Grove, IL (US); Bruce Bernhardt, Wauconda, IL (US); Arnold Sheynman, Northbrook, IL (US); Xin Gao, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 0 days.

(21) Appl. No.: 15/473,053

(22) Filed: Mar. 29, 2017

(65) Prior Publication Data

US 2018/0286228 A1 Oct. 4, 2018

(51) Int. Cl.
*G08G 1/082* (2006.01)

(52) U.S. Cl.
CPC ..... *G08G 1/082* (2013.01)

(58) Field of Classification Search
CPC ..... G08G 1/082
See application file for complete search history.

(56) References Cited

U.S. PATENT DOCUMENTS 6,317,058 B1 11/2001 Lemelson et al.
6,317,686 B1 * 11/2001 Ran ..... G01C 21/3691 701/117
2003/0069683 A1 * 4/2003 Lapidot ..... G01C 21/34 701/117

(Continued)

FOREIGN PATENT DOCUMENTS

CN 1710626 A 12/2005
CN 202904889 4/2013

(Continued)

OTHER PUBLICATIONS

Castermans, J., *Multimodality for People and Goods in Urban Areas*, Research Paper, ERTICO, FP7.CP 284906 (Mar. 2013) 152 pages.

(Continued)

*Primary Examiner* — Sisay Yacob
(74) *Attorney, Agent, or Firm* — Alston & Bird LLP

(57) ABSTRACT

A method is provided for controlling traffic lights of a road geometry network using a cloud-based traffic control system. Methods may include: receiving map data including road network geometry and traffic light locations relative to intersections of the road network geometry; receiving signal phase and timing of traffic lights at the traffic light locations; receiving probe and sensor data from a plurality of probes traversing the road network geometry; analyzing the received probe and sensor data from the plurality of probes relative to the road network geometry and the traffic light locations; determining revised signal phase and timing for at least one traffic light within the road network geometry based on the analyzed probe and sensor data relative to the road network geometry and the traffic light locations; and providing revised signal phase and timing to the at least one traffic light within the road network geometry.

23 Claims, 6 Drawing Sheets

(56) References Cited

U.S. PATENT DOCUMENTS

| | | | | |
|---|---|---|---|---|
| 2016/0203717 | A1* | 7/2016 | Ginsberg | G08G 1/07 701/117 |
| 2016/0260325 | A1 | 9/2016 | Modica et al. | |
| 2016/0321598 | A1* | 11/2016 | Baughman | G06Q 10/063114 |
| 2016/0321599 | A1* | 11/2016 | Baughman | G06Q 10/063114 |

FOREIGN PATENT DOCUMENTS

| | | | |
|---|---|---|---|
| CN | 103473939 | A | 12/2013 |
| EP | 0715287 | | 6/1996 |

OTHER PUBLICATIONS

Munst, W. et al., *Virtual Traffic Lights—Managing Intersections in the Cloud*, Research Paper, IEEE 2015 (2015) pp. 329-334.

Arterial Management: Traffic Control [online] [retrieved Oct. 24, 2016]. Retrieved from the Internet: <http://www.itskowledgeresources.its.dot.gov/its/bellupdate/ArterialTrafficControl>. (dated 2014) 5 pages.

Traffic light control and coordination—Wikipedia [online] [retrieved Aug. 1, 2017]. Retrieved from the Internet: <https://en.wikipedia.org/wiki/Traffic_light_control_and_coordination>. (dated Jun. 23, 2017) 4 pages.

Fayazi et al., "Crowdsourcing Phase and Timing of Pre-Timed traffice Signals in the Presence of Queues: Algorithms and Back-End System Architecture" IEEE Transactions on Intelligent Transportation Systems, IEEE, Piscataway, NJ, USA, vol. 17, No. 3, Mar. 1, 2016, pp. 870-881.

International Search Report and Written Opinion for International Application No. PCT/IB2018/051988 dated Jun. 20, 2018, 20 pages.

* cited by examiner

METHOD, APPARATUS AND COMPUTER PROGRAM PRODUCT FOR COMPREHENSIVE MANAGEMENT OF SIGNAL PHASE AND TIMING OF TRAFFIC LIGHTS

TECHNICAL FIELD

An example embodiment of the present invention relates generally to remote signal phase and timing of traffic lights, and more particularly, to cloud based virtual traffic light management and communication of signal phase and timing messages to traffic lights.

BACKGROUND

Transportation infrastructure has evolved from carriageways with intersections lacking any traffic control measures to become a complex network of roadways with complex roadway interchanges and countless traffic patterns that are managed through different types of intersections. Traffic lights have long been a mainstay of controlling traffic through intersections to avoid accidents, though the proliferation of vehicles on our roadways has rendered traffic lights, at many times, a hindrance to efficient traffic flow through intersections. Modern signal phase and timing technology has helped in this regard, as have computerized networks to manage traffic and infrastructure. Municipal infrastructure has also benefited from networking technology, such as the networking of traffic control signals to facilitate traffic flow through intersections and along routes.

In the area of traffic control, intersections play a critical role in traffic flow management. Intersections having traffic control signals provide intersection movement state control strategies to ensure vehicle capacity and safety on the roads. Traffic light signal phase and timing may not readily adapt to changes in traffic flow that may be caused by anomalies, such as pedestrian crossings, emergency vehicles, accidents, unusual traffic, or the like. This may cause the traffic light timing to become a hindrance in the efficient flow of traffic through an intersection.

BRIEF SUMMARY

In general, an example embodiment of the present invention provides an improved method of traffic light management and the communication of signal phase and timing messages to traffic lights to facilitate greater efficiency and throughput of intersection traffic flow, and to enable traffic light management to accommodate anomalies in traffic behavior. According to an example embodiment, a traffic control system may be provided including a memory having map data with road network geometry and traffic light locations relative to intersections of the road network geometry, and processing circuitry. The processing circuitry may be configured to: receive signal phase and timing of traffic lights at the traffic light locations; receive probe and sensor data from a plurality of probes traversing the road network geometry; analyze the received probe and sensor data from the plurality of probes relative to the road network geometry and the traffic light locations; determine revised signal phase and timing for at least one traffic light within the road network geometry based on the analyzed probe and sensor data relative to the road network geometry and the traffic light locations; provide revised signal phase and timing to the at least one traffic light within the road network geometry; and cause the at least one traffic light to be controlled using the revised signal phase and timing.

According to some embodiments, each traffic light may be associated with a traffic light controller, where the processing circuitry configured to provide revised signal phase and timing to the at least one traffic light may include processing circuitry to send a revised signal phase and timing message to the respective traffic light controller. The processing circuitry may optionally be configured to: analyze probe and sensor data from a plurality of past epochs; determine an epoch specific signal phase and timing for at least one traffic light within the road network geometry for a future epoch associated with at least one of the plurality of past epochs; provide the epoch specific signal phase and timing to the at least one traffic light; and cause the at least one traffic light to be controlled using the epoch specific signal phase and timing in response to the future epoch becoming the present epoch. The processing circuitry configured to analyze the received probe and sensor data from the plurality of probes relative to the road network geometry and the traffic light locations may include processing circuitry configured to: analyze probe and sensor data approaching an intersection; and determine revised signal phase and timing for a traffic light associated with the intersection based on the probe and sensor data approaching the intersection.

According to some embodiments, the processing circuitry configured to analyze the received probe and sensor data from the plurality of probes relative to the road network geometry and the traffic light locations may include processing circuitry configured to: determine sensor data from probe and sensor data proximate an intersection indicates a windshield wiper rate; and determine revised signal phase and timing for at least one traffic light associated with the intersection based, at least in part, on the windshield wiper rate. The revised signal phase and timing for the at least one traffic light associated with the intersection may include incorporating a safety buffer in the revised signal phase and timing to account for diminished reaction times. The processing circuitry configured to analyze the received probe and sensor data from the plurality of probes relative to the road network geometry and the traffic light locations may include processing circuitry configured to: determine sensor data from probe and sensor data proximate an intersection indicates a traction control event; and determine revised signal phase and timing for at least one traffic light associated with the intersection based, at least in part, on the traction control event. The processing circuitry configured to cause the at least one traffic light to be controlled using the revised signal phase and timing may include causing the at least one traffic light to be controlled remotely from a central location from which a plurality of traffic lights at a plurality of intersections of the road network geometry are controlled.

According to an example embodiment, an apparatus may be provided including at least one processor and at least one memory including computer program code stored thereon. The at least one memory and the computer program code are configured to, with the at least one processor, cause the apparatus to: receive map data including road network geometry and traffic light locations relative to intersections of the road network geometry; receive signal phase and timing of traffic lights at the traffic light locations; receive probe and sensor data from a plurality of probes traversing the road network geometry; analyze the received probe and sensor data from the plurality of probes relative to the road network geometry and the traffic light locations; determine revised signal phase and timing for at least one traffic light within the road network geometry based on the analyzed probe and sensor data relative to the road network geometry and the traffic light locations; and provide revised signal phase and timing to the at least one traffic light within the road network geometry. Each traffic light may be associated with a traffic light controller such that causing the apparatus to provide revised signal phase and timing to the at least one traffic light controller may include sending a revised signal phase and timing message to the traffic light controller.

The apparatus of some embodiments may be caused to: analyze probe and sensor data from a plurality of past epochs; determine an epoch specific signal phase and timing for at least one traffic light within the road network geometry for a future epoch associated with at least one of the plurality of past epochs; provide the epoch specific signal phase and timing to the at least one traffic light; and cause the at least one traffic light to be controlled using the epoch specific signal phase and timing in response to the future epoch becoming a present epoch. Causing the apparatus to analyze the received probe and sensor data from the plurality of probes relative to the road network geometry and the traffic light locations may include causing the apparatus to: analyze probe and sensor data approaching an intersection; and determine revised signal phase and timing for a traffic light associated with the intersection based on the probe and sensor data approaching the intersection;

According to some embodiments, causing the apparatus to analyze the probe and sensor data from the plurality of probes relative to the road network geometry and the traffic light locations may include causing the apparatus to: determine sensor data from probe and sensor data proximate an intersection indicates a windshield wiper rate; and determine revised signal phase and timing for at least one traffic light associated with the intersection based, at least in part, on the windshield wiper rate. The revised signal phase and timing for the at least one traffic light associated with the intersection may include incorporating a safety buffer in the revised signal phase and timing to account for diminished reaction times. Causing the apparatus to analyze the received probe and sensor data from the plurality of probes relative to the road network geometry and the traffic light locations may include causing the apparatus to: determine sensor data from probe and sensor data proximate an intersection indicates a traffic control event; and determine revised signal phase and timing for at least one traffic light associated with the intersection based, at least in part, on the traction control event. Causing the apparatus to provide revised signal phase and timing to the at least one traffic light within the road network geometry may include causing the apparatus to cause the at least one traffic light to be controlled remotely from a central location from which a plurality of traffic lights at a plurality of intersections of the road network geometry are controlled.

Certain embodiments described herein may provide a computer program product including at least one non-transitory computer-readable storage medium having computer executable program code instructions stored therein. The computer-executable program code instructions may include instructions to: receive map data including road network geometry and traffic light locations relative to intersections of the road network geometry; receive signal phase and timing of traffic lights at the traffic light locations; receive probe and sensor data from a plurality of probes traversing the road network geometry; analyze the received probe and sensor data from the plurality of probes relative to the road network geometry and the traffic light locations; determine revised signal phase and timing for at least one traffic light within the road network geometry based on the analyzed probe and sensor data relative to the road network geometry and the traffic light locations; and provide revised signal phase and timing to the at least one traffic light within the road network geometry. Each traffic light may be associated with a traffic light controller such that the revised signal phase and timing is provided in a signal phase and timing message to the traffic light controller.

The computer program product of an example embodiment may optionally include program code instructions to: analyze probe and sensor data from a plurality of past epochs; determine an epoch specific signal phase and timing for at least one traffic light within the road network geometry for a future epoch associated with at least one of the plurality of past epochs; provide the epoch specific signal phase and timing to the at least one traffic light; and cause the at least one traffic light to be controlled using the epoch specific signal phase and timing in response to the future epoch becoming a present epoch. The program code instructions to analyze the received probe and sensor data from the plurality of probes relative to the road network geometry and the traffic light locations may include program code instructions to: analyze probe and sensor data approaching an intersection; and determine revised signal phase and timing for a traffic light associated with the intersection based on the probe and sensor data approaching the intersection.

According to some embodiments, the program code instructions to analyze the received probe and sensor data from the plurality of probes relative to the road network geometry and the traffic light locations may include program code instructions to: determine sensor data from probe and sensor data proximate an intersection indicates a windshield wiper rate; and determine revised signal phase and timing for at least one traffic light associated with the intersection based, at least in part, on the windshield wiper rate. The revised signal phase and timing for the at least one traffic light associated with the intersection may include incorporating a safety buffer in the revised signal phase and timing to account for diminished reaction times. The program code instructions to analyze the received probe and sensor data from the plurality of probes relative to the road network geometry and the traffic light locations may include program code instructions to: determine sensor data from probe and sensor data proximate an intersection indicates a traction control event; and determine revised signal phase and timing for at least one traffic light associated with the intersection based, at least in part, on the traction control event. The program code instructions configured to provide a revised signal phase and timing to the at least one traffic light within the road network geometry may include program code instructions to cause the at least one traffic light to be controlled remotely from a central location from which a plurality of traffic lights at a plurality of intersections of the road network geometry are controlled.

Certain embodiments described herein may provide a method including: receiving map data including road network geometry and traffic light locations relative to intersections of the road network geometry; receiving signal phase and timing of traffic lights at the traffic light locations; receiving probe and sensor data from a plurality of probes traversing the road network geometry; analyzing the received probe and sensor data from the plurality of probes relative to the road network geometry and the traffic light locations; determining revised signal phase and timing for at least one traffic light within the road network geometry based on the analyzed probe and sensor data relative to the road network geometry and the traffic light locations; and providing revised signal phase and timing to the at least one traffic light within the road network geometry. Each traffic light may be associated with a traffic light controller, and providing revised signal phase and timing to the at least one traffic light may include sending a revised signal phase and timing message to the traffic light controller. Methods may optionally include: analyzing probe and sensor data from a plurality of epochs; determining an epoch specific signal phase and timing for at least one traffic light within the road network geometry for a future epoch associated with at least one of the plurality of past epochs; providing the epoch specific signal phase and timing to the at least one traffic light; and causing the at least one traffic light to be controlled using the epoch specific signal phase and timing in response to the future epoch becoming a present epoch.

Certain embodiments described herein may provide an apparatus including: means for receiving map data including road network geometry and traffic light locations relative to intersections of the road network geometry; means for receiving signal phase and timing of traffic lights at the traffic light locations; means for receiving probe and sensor data from a plurality of probes traversing the road network geometry; means for analyzing the received probe and sensor data from the plurality of probes relative to the road network geometry and the traffic light locations; means for determining revised signal phase and timing for at least one traffic light within the road network geometry based on the analyzed probe and sensor data relative to the road network geometry and the traffic light locations; and means for providing revised signal phase and timing to the at least one traffic light within the road network geometry. Each traffic light may be associated with a traffic light controller, and providing revised signal phase and timing to the at least one traffic light may include sending a revised signal phase and timing message to the traffic light controller. An apparatus of an example embodiment may optionally include: means for analyzing probe and sensor data from a plurality of epochs; means for determining an epoch specific signal phase and timing for at least one traffic light within the road network geometry for a future epoch associated with at least one of the plurality of past epochs; means for providing the epoch specific signal phase and timing to the at least one traffic light; and means for causing the at least one traffic light to be controlled using the epoch specific signal phase and timing in response to the future epoch becoming a present epoch.

BRIEF DESCRIPTION OF THE DRAWINGS

Figure 1:
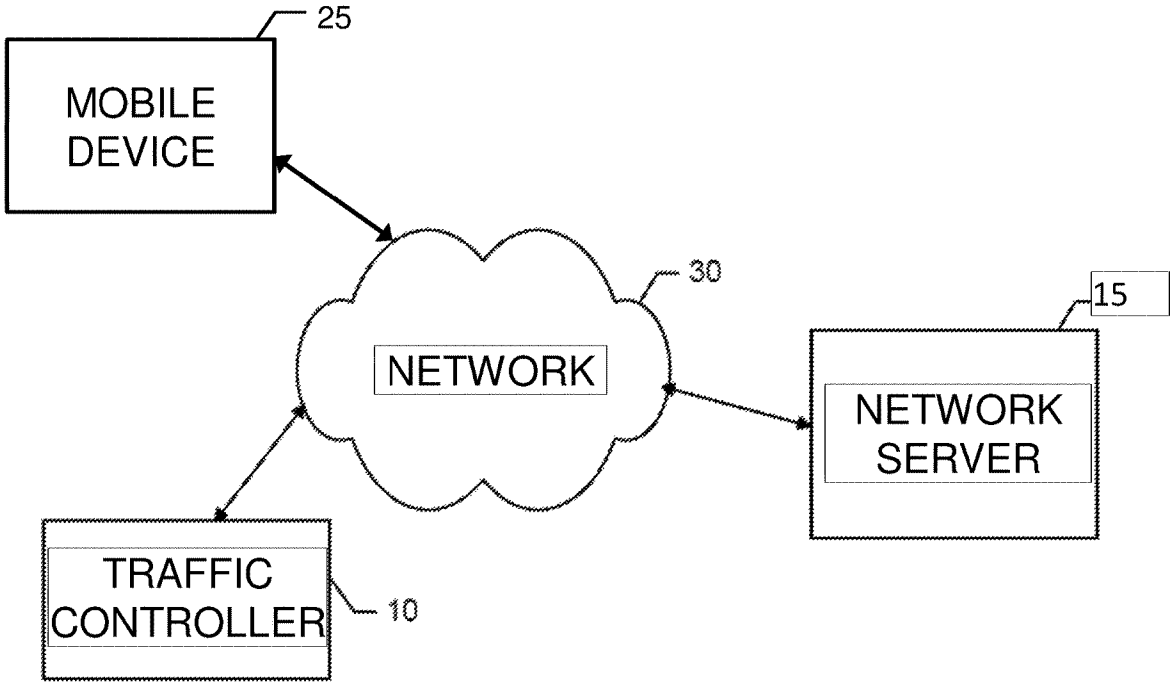
Figure 2:
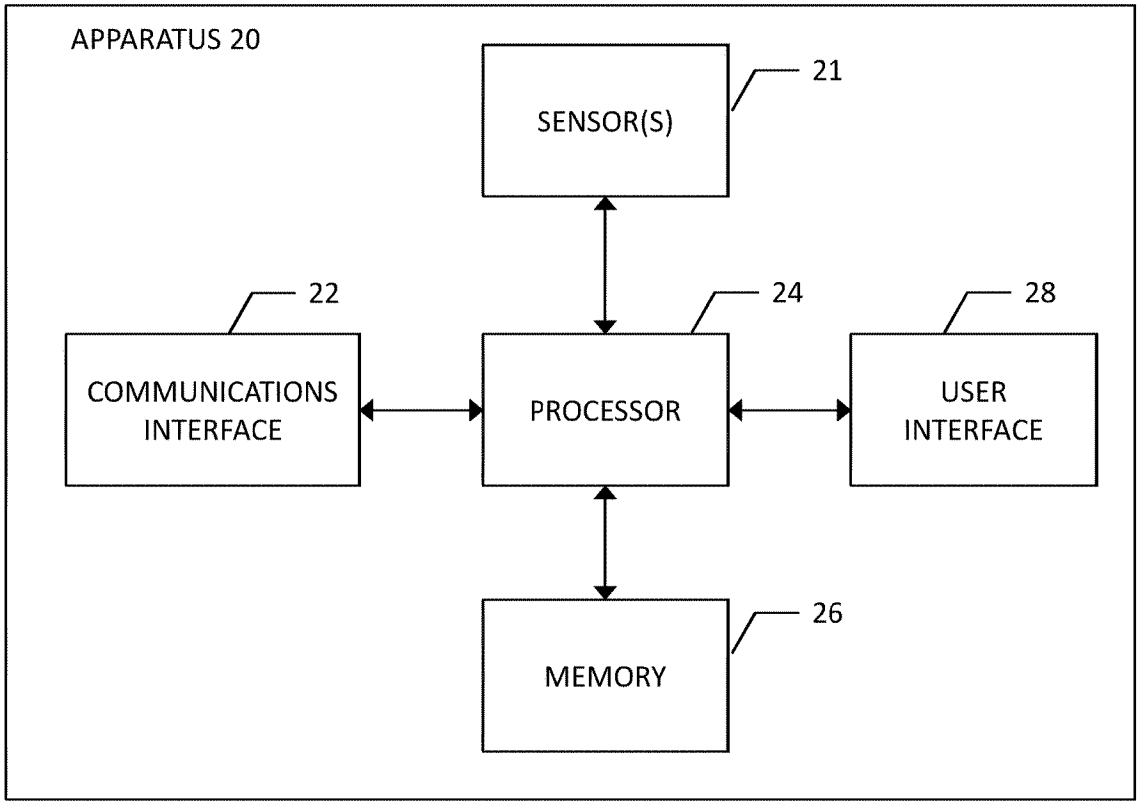
Figure 3:
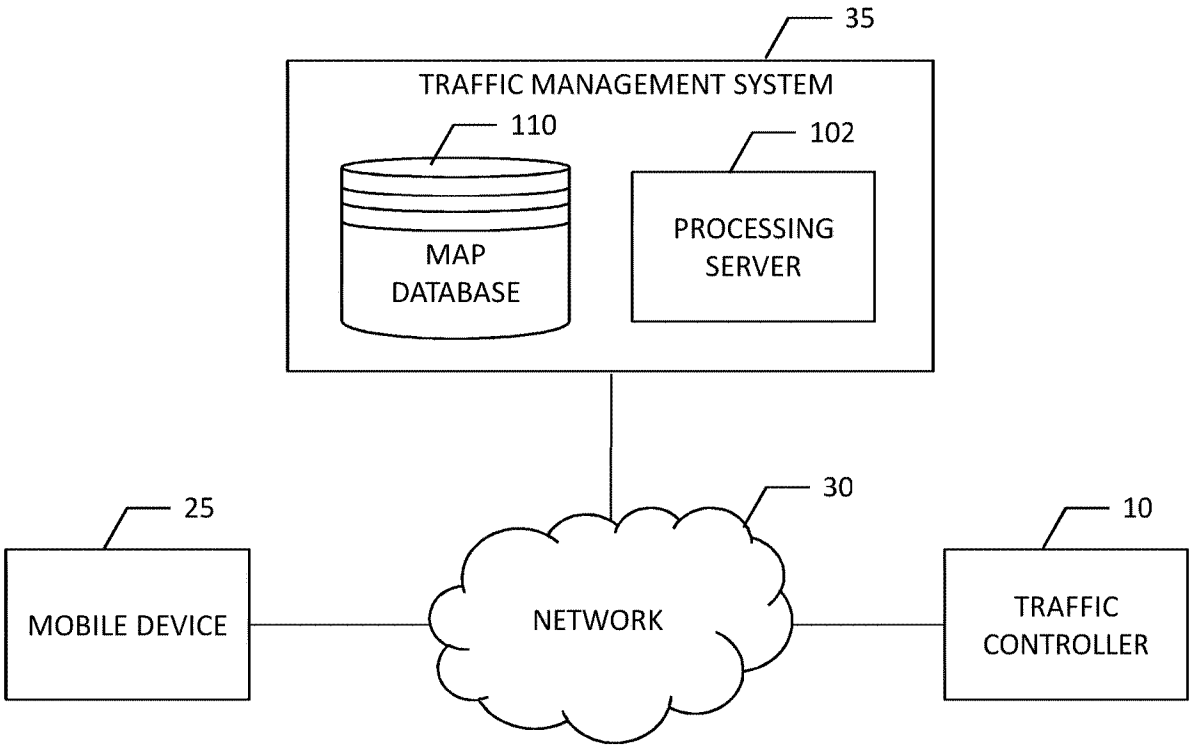
Figure 4:
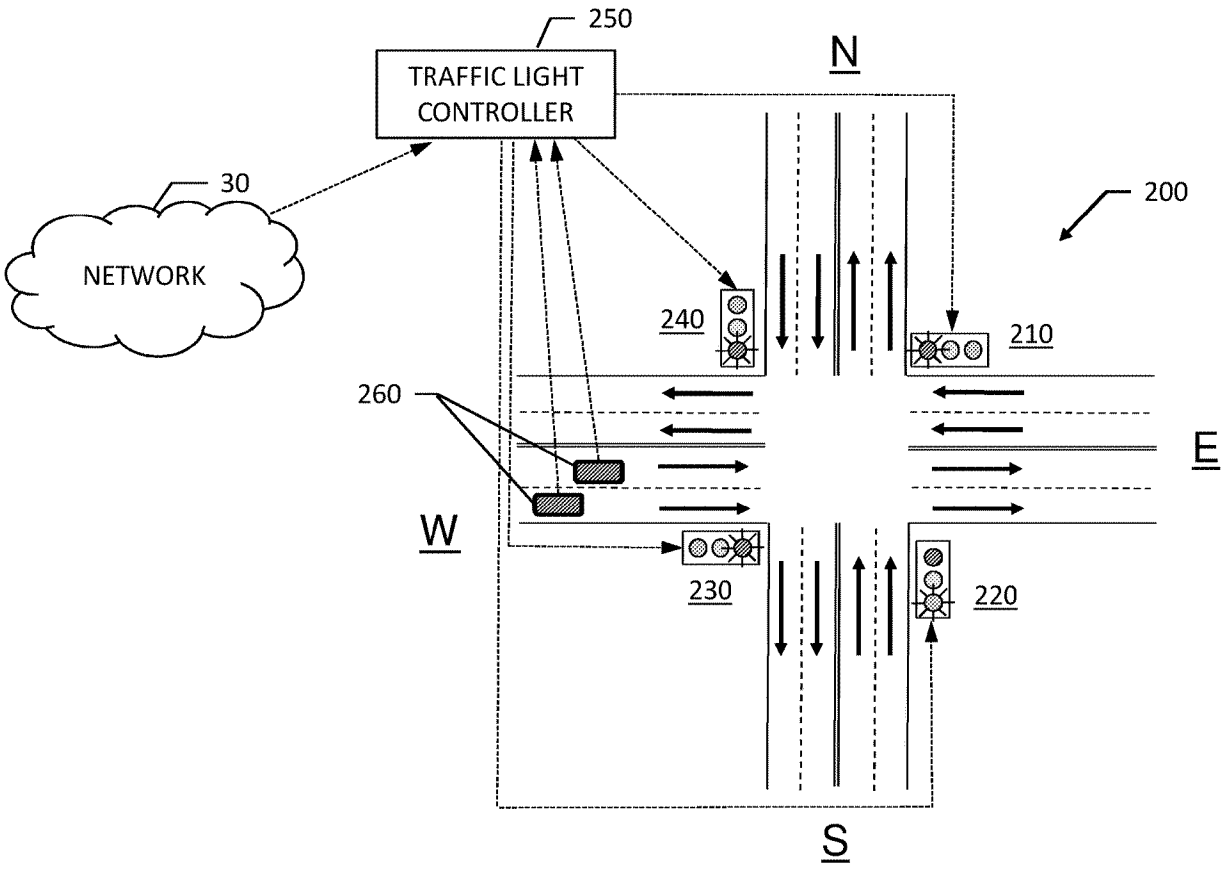
Figure 5:
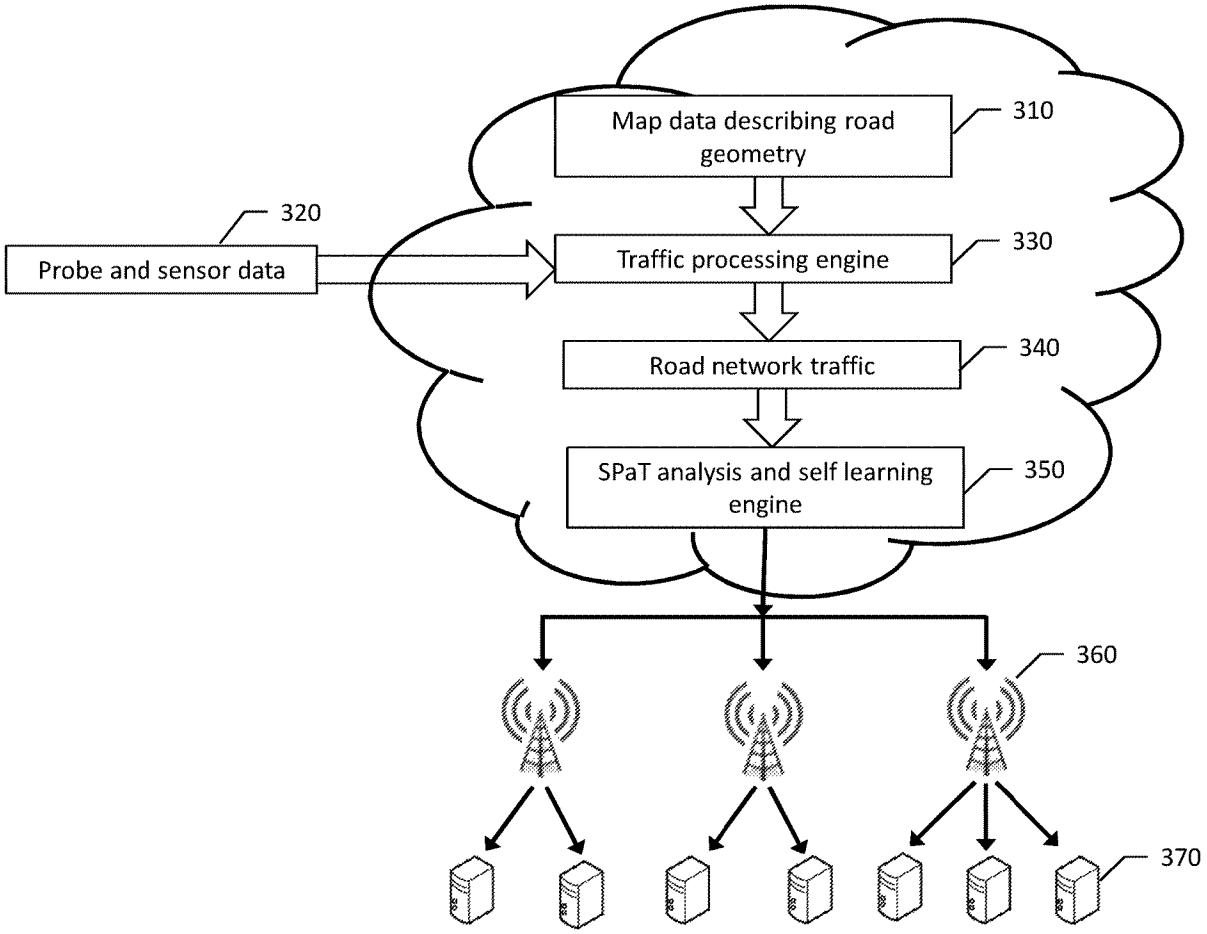
Figure 6:
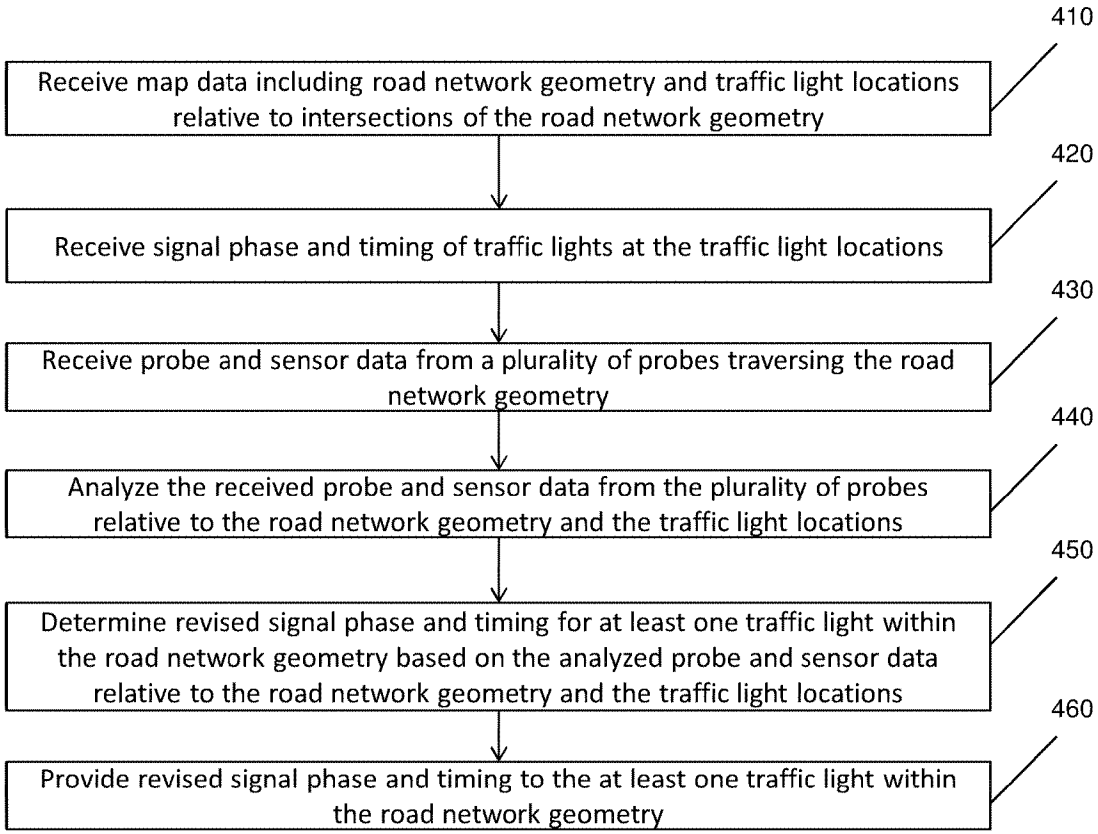

Having thus described some example embodiments of the invention in general terms, reference will now be made to the accompanying drawings, which are not necessarily drawn to scale, and wherein:

FIG. 1 illustrates an communication system in accordance with an example embodiment of the present invention;

FIG. 2 is a schematic block diagram of an apparatus according to an example embodiment of the present invention;

FIG. 3 depicts another communication system in accordance with an example embodiment of the present invention;

FIG. 4 is a schematic illustration of an intersection including traffic lights and a traffic controller according to an example embodiment of the present invention;

FIG. 5 is a flow chart of a method for traffic control via a cloud based system according to an example embodiment of the present invention; and FIG. 6 is another flow chart illustrating a method for revising signal phase and timing using a traffic control system according to an example embodiment of the present invention.

DETAILED DESCRIPTION

Some example embodiments of the present invention will now be described more fully hereinafter with reference to the accompanying drawings, in which some, but not all embodiments of the invention are shown. Indeed, various embodiments of the invention may be embodied in many different forms and should not be construed as limited to the example embodiments set forth herein; rather, these example embodiments are provided so that this disclosure will satisfy applicable legal requirements. Like reference numerals refer to like elements throughout. As used herein, the terms "data," "content," "information" and similar terms may be used interchangeably to refer to data capable of being transmitted, received and/or stored in accordance with embodiments of the present invention.

An example embodiment of the present invention may be used in conjunction with, or implemented by, a plurality of components of a system for comprehensive management of signal phase and timing for traffic lights controlling intersections of a road network geometry. According to some embodiments as illustrated in FIG. 1, a system that may benefit from an example embodiment of the present invention may include a traffic controller 10 which controls the traffic signals at an intersection, such as through the traffic light signal phase and timing (SPaT), together with sequences and patterns of traffic light function. The traffic controller 10 may be located proximate the intersection of the traffic light, or the traffic controller may be located remotely from the controlled traffic light and in communication with the traffic light through various types of wired or wireless communications, as further described below. The system may further include a network server 15 that is in communication with the traffic controller, such as via network 30, to provide information and commands to the traffic controller, and/or to receive information and data from the traffic controller, such as traffic volumes, hardware issues, or various other information that may be useful in the control of a traffic system.

Traffic control systems of various embodiments may further include or be in communication with a mobile device 25 which may be a vehicle probe for communicating vehicle probe data and sensor data from the vehicle to the network 30. Vehicle probe data may be location, heading, speed, etc. Probe data may further include sensor data from one or more sensors associated with the mobile device 25 described further below.

More specifically, probe data (e.g., collected by mobile device 25) may be representative of the location of a vehicle at a respective point in time and may be collected while a vehicle is traveling along a route. While probe data is described herein as being vehicle probe data, example embodiments may be implemented with pedestrian probe data, marine vehicle probe data, or non-motorized vehicle probe data (e.g., from bicycles, skate boards, horseback, etc.) which may be traveling along signal-controlled paths through an intersection, such as through pedestrian or bicycle phases of a traffic signal. According to the example embodiment described below with the probe data being from motorized vehicles traveling along roadways, the probe data may include, without limitation, location data, (e.g. a latitudinal, longitudinal position, and/or height, GPS coordinates, proximity readings associated with a radio frequency identification (RFID) tag, or the like), rate of travel, (e.g. speed), direction of travel, (e.g. heading, cardinal direction, or the like), device identifier, (e.g. vehicle identifier, user identifier, or the like), a time stamp associated with the data collection, or the like. The mobile device 25, may be any device capable of collecting the aforementioned probe data. Some examples of the mobile device 25 may include specialized vehicle mapping equipment, navigational systems, mobile devices, such as phones or personal data assistants, or the like.

Communication may be supported by network 30 as shown in FIG. 1 that may include a collection of various different nodes, devices, or functions that may be in communication with each other via corresponding wired and/or wireless interfaces, or in ad-hoc networks such as those functioning over Bluetooth® connection(s), Wi-Fi or various cellular networks supporting ad-hoc communication. As such, FIG. 1 should be understood to be an example of a broad view of certain elements of a system that may incorporate an example embodiment of the present invention and not an all inclusive or detailed view of the system or the network 30. Although not necessary, in some example embodiments, the network 30 may be capable of supporting communication in accordance with any one or more of a number of first-generation (1G), second-generation (2.G), 2.5G, third-generation (3G), 3.5G, 3.9G, fourth-generation (4G) mobile communication protocols and/or the like.

One or more communication terminals, such as traffic controller 10 may be in communication with the network server 15 via the network 30, and each may include an antenna or antennas for transmitting signals to and for receiving signals from a base site, which could be, for example a base station that is part of one or more cellular or mobile networks or an access point that may be coupled to a data network; such as a local area network (LAN), a metropolitan area network (MAN), and/or a wide area network (WAN), such as the Internet. In turn, other devices (e.g., personal computers, server computers, or the like) may be coupled to the traffic controller 10, network server 15, or mobile device 25, via the network 30. By directly or indirectly connecting the mobile device 25, the traffic controller 10, the network server 15, and other devices to the network 30, the mobile device 25 and traffic controller 10 may be enabled to communicate with the other devices or each other, for example, according to numerous communication protocols including Hypertext Transfer Protocol (HTTP) and/or the like, to thereby carry out various communication or other functions of the traffic controller 10 and/or the mobile device 25.

According to some example embodiments, the mobile device 25 may be embodied by a mobile terminal which may be a mobile communication device, and the traffic controller 10 may be embodied by a fixed communication device. Thus, for example, the mobile device could be, or be substituted by, one or more of personal digital assistants (PDAs), wireless telephones, laptop computers, mobile computers, cloud based computing systems, or various other devices or combinations thereof. The traffic controller could be, or be substituted by, one or more of personal computers (PCs), personal digital assistants (PDAs), wireless telephones, desktop computers, laptop computers, mobile computers, cloud based computing systems, or various other devices or combinations thereof.

Although the mobile device 25, traffic controller 10, and network server 15 may be configured in various manners, one example of an apparatus that may function as one or more of the aforementioned components to facilitate an embodiment of the present invention is depicted in the block diagram of FIG. 2. Apparatus 20 of FIG. 2 is an example embodiment that may be embodied by or associated with any of a variety of computing devices that include or are otherwise associated with a device configured for providing a navigation system user interface. For example, the computing device may be a mobile terminal, such as a personal digital assistant (PDA), mobile telephone, smart phone, personal navigation device, smart watch, tablet computer, camera or any combination of the aforementioned and other types of voice and text communications systems. Optionally, the computing device may be a fixed computing device, such as a built-in vehicular navigation device, assisted driving device, or the like. Apparatus 20 may be a computational unit to aid the vehicle in autonomous or highly automated driving decisions, such as when to consider onboard vehicle sensor inputs.

Optionally, the apparatus may be embodied by or associated with a plurality of computing devices that are in communication with or otherwise networked with one another such that the various functions performed by the apparatus may be divided between the plurality of computing devices that operate in collaboration with one another.

The apparatus 20 may be equipped with any number of sensors 21, such as a global positioning system (GPS), accelerometer, and/or gyroscope. Any of the sensors may be used to sense information regarding the movement, positioning, or orientation of the device for use in navigation assistance, as described herein according to an example embodiment. In some example embodiments, such sensors may be implemented in a vehicle or other remote apparatus, and the information detected may be transmitted to the apparatus 20, such as by near field communication (NFC) including, but not limited to, Bluetooth™ communication, or the like. In an embodiment in which the apparatus 20 functions as the mobile device 25, sensors may optionally include vehicle data, such as vehicle speed, heading, vehicle operating modes, windshield wiper speed, traction control warnings, emergency braking sensors (e.g., antilock braking systems or anti-lock braking system (ABS) activation), etc.

The apparatus 20 may include, be associated with, or may otherwise be in communication with a communication interface 22, processor 24, a memory device 26 and a user interface 28. In some embodiments, the processor (and/or co-processors or any other processing circuitry assisting or otherwise associated with the processor) may be in communication with the memory device via a bus for passing information among components of the apparatus. The memory device may be non-transitory and may include, for example, one or more volatile and/or non-volatile memories. In other words, for example, the memory device may be an electronic storage device (for example, a computer readable storage medium) comprising gates configured to store data (for example, bits) that may be retrievable by a machine (for example, a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor. Additionally or alternatively, the memory device could be configured to store instructions for execution by the processor.

The processor 24 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 24 may be configured to execute instructions stored in the memory device 26 or otherwise accessible to the processor. Alternatively or additionally, the processor may be configured to execute hard coded functionality. As such, whether configured by hardware or software methods, or by a combination thereof, the processor may represent an entity (for example, physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device (for example, the computing device) configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

The apparatus 20 of an example embodiment may also include or otherwise be in communication with a user interface 28. The user interface may include a touch screen display, a speaker, physical buttons, and/or other input/output mechanisms. In an example embodiment, the processor 24 may comprise user interface circuitry configured to control at least some functions of one or more input/output mechanisms. The processor and/or user interface circuitry comprising the processor may be configured to control one or more functions of one or more input/output mechanisms through computer program instructions (for example, software and/or firmware) stored on a memory accessible to the processor (for example, memory device 24, and/or the like). In this regard, the apparatus 20 may interpret positioning data collected by its sensors and provide a destination preview including visual and audio feedback, to a user, for example.

The apparatus 20 of an example embodiment may also optionally include a communication interface 22 that may be any means such as a device or circuitry embodied in either hardware or a combination of hardware and software that is configured to receive and/or transmit data from/to other electronic devices in communication with the apparatus, such as by NFC, described above. Additionally or alternatively, the communication interface 22 may be configured to communicate over Global System for Mobile Communications (GSM), such as but not limited to Long Term Evolution (LTE). In this regard, the communication interface 22 may include, for example, an antenna (or multiple antennas) and supporting hardware and/or software for enabling communications with a wireless communication network. Additionally or alternatively, the communication interface 22 may include the circuitry for interacting with the antenna(s) to cause transmission of signals via the antenna(s) or to handle receipt of signals received via the antenna(s). In some environments, the communication interface 22 may alternatively or also support wired communication may alternatively support vehicle to vehicle or vehicle to infrastructure wireless links.

The apparatus 20 may support a mapping application, such as may be stored by memory 26 and executed by the processor 24, so as to present maps or otherwise provide navigation assistance. In order to support a mapping application, the computing device may include or otherwise be in communication with a geographic database, such as may be stored in memory 26. For example, the geographic database includes node data records, road segment or link data records, point of interest (POI) data records, and other data records. More, fewer or different data records can be provided. In one embodiment, the other data records include cartographic data records, routing data, and maneuver data. One or more portions, components, areas, layers, features, text, and/or symbols of the POI or event data can be stored in, linked to, and/or associated with one or more of these data records. For example, one or more portions of the POI, event data, or recorded route information can be matched with respective map or geographic records via position or GPS data associations (such as using known or future map matching or geo-coding techniques), for example. Furthermore, other positioning technology may be used, such as electronic horizon sensors, radar, light detection and ranging (LIDAR), ultrasonic and/or infrared sensors.

According to some example embodiments described herein, a traffic controller, which may be embodied by apparatus 20, may be connected, such as via a network, to a traffic management system as shown in FIG. 3. The network server 15 of FIG. 1 may be embodied by traffic management system 35 of FIG. 3 and may include a map database that includes information related to road network geometry, intersections, and traffic light locations relative to intersections of the road network geometry. The illustrated embodiment of FIG. 3 includes a mobile device 25, which may be, for example, the apparatus 20 of FIG. 2, such as a mobile phone, an in-vehicle navigation system, or the like, and a traffic management system 35, which may include map data service provider or cloud service. Each of the mobile device 25 and traffic management system 35 may be in communication with at least one of the other elements illustrated in FIG. 3 via a network 30, which may be any form of wireless or partially wireless network as will be described further below. Additional, different, or fewer components may be provided. For example, many mobile devices 25 may connect with the network 30. The traffic management system 35 may be cloud-based services and/or may operate via a hosting server that receives, processes, and provides data to other elements of the system. A plurality of traffic controllers 10 may be connected, via the network 30, to the traffic management system 35.

The traffic management system 35 may include a map database 110 that may include node data, road segment data or link data, road network geometry, intersection information, traffic light location information, traffic light signal phase and timing information, traffic data or the like.

According to some example embodiments, the road network geometry may include segment data records which may be links or segments representing roads, streets, or paths. The road link data and the node data may represent a road network, such as used by vehicles, cars, trucks, buses, motorcycles, and/or other entities. Where road segments intersect, intersection geometry may also be stored at the map database 110, including any relevant traffic signals. The road/link segments and nodes can be associated with attributes, such as geographic coordinates, street names, address ranges, speed limits, turn restrictions at intersections, and other navigation related attributes, as well as points of interest.

The map database 110 may be maintained by a content provider e.g., a traffic management service provider and may be accessed, for example, by the content or service provider processing server 102. By way of example, the traffic management system can collect geographic data and dynamic data to generate and enhance the map database 110 and dynamic data such as traffic-related data contained therein. There can be different ways used by the traffic management system to collect data. These ways can include obtaining data from other sources, such as municipalities or respective geographic authorities, such as via global information system databases. In addition, the traffic management system can employ field personnel to travel by vehicle along roads throughout the geographic region to observe features and/or record information about them, for example. Also, remote sensing, such as aerial or satellite photography and/or LIDAR, can be used to generate map geometries directly or through machine learning or deep learning as described herein. However, the most ubiquitous form of data that may be available is vehicle data provided by vehicles, such as mobile device 25, as they travel the roads throughout a region.

The map database 110 may be a master map database stored in a format that facilitates updates, maintenance, and development. For example, the master map database or data in the master map database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data may be compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by a vehicle represented by mobile device 25, for example. The navigation-related functions can correspond to vehicle navigation, pedestrian navigation, or other types of navigation.

In one embodiment, as noted above, the end user device or mobile device 25 can be embodied by the apparatus 20 of FIG. 2 and can include an in-vehicle navigation system, such as a vehicle infotainment system, a navigation head-unit device, a personal navigation device (PND), a portable navigation device, a cellular telephone, a smart phone, a personal digital assistant (PDA), a watch, a camera, a computer, and/or other device that can perform navigation-related functions, such as digital routing and map display or an ADAS (advanced driver assistance system).

In general, an example embodiment of the present invention may provide a method for traffic light signal and phase timing (SPaT) control by a virtual traffic light controller which can be managed by a traffic management system, with or without the support and assistance from traffic service providers.

A traffic signal of an intersection is conventionally controlled by a controller inside a cabinet mounted at the intersection. The traffic control cabinet may include: a power panel to distribute electrical power to the cabinet; a detector interface panel to connect to loop detectors and other detectors; detector amplifiers; the controller itself; a conflict monitor unit; flash transfer relays; a police panel to allow authorities to disable or manually control the signal; and other components. The signal phase and timing of each traffic light can be based on traffic congestion analysis of the regional road network where a local agency can manage traffic planning to improve road traffic efficiency. However, this requires complex planning and coordination to ensure the intersection safety and to ensure the smoothest possible traffic flow. Traffic light phase and timing may be fixed for all times of day and days of the year, or adaptive in association with various sensor inputs, such as a pedestrian crossing request button, a magnetic field sensor in the roadway to detect the presence of stopped vehicles, emergency responder signals, or the like. Complexities of signal phase and timing planning are magnified in areas having many intersections and traffic lights as traffic light synchronization can be important to facilitate smooth traffic flow.

In the area of traffic control, intersections are critical to traffic flow management. Intersections having traffic signals that are controlled by traffic network systems can provide intersection movement state control strategies that maximize vehicle capacity, maximize traffic flow efficiency, and improve safety on the associated roads. Generally, each intersection and traffic light has its own assigned signal phase and timing (SPaT) control strategy. With the knowledge of such information, opportunities exist for traffic service providers or traffic management agencies (e.g., departments of transportation) to benefit the automotive industry through maximizing fuel efficiency, minimizing congestion, and improving capacity through avoiding or reducing unnecessary stop-and-go traffic. Heavy traffic can lead to periodic acceleration and deceleration caused by poorly timed traffic signals and inconsistent traffic flow patterns. Minimizing such inefficiencies can reduce travel time and improve safety.

Traffic congestion may occur due to out-of-sync traffic lights, particularly if traffic volumes exceed the available road capacity. Further, traffic accidents, times of heavy congestion (e.g., during rush hour or a special event such as a sporting event) may exacerbate problems with traffic light signal and phase timing. Traffic signals are often not connected or synchronized with one another, particularly when different entities control different traffic signals near one another, such as traffic lights on county roads near county borders. Further, traffic volumes regularly change with increased development (residential, commercial, industrial, etc.) and during times when heavy traffic is re-routed due to road closures or road restrictions.

Certain embodiments described herein can provide signal phase and timing control incorporating real time traffic conditions proximate intersections using probe data and sensor technologies. This provides opportunities to allow traffic lights to be controlled centrally and to quickly adapt to changing traffic flow situations, even when they are not routine (e.g., daily or seasonal) traffic anomalies. Provided herein is a virtual traffic light control strategy using cellular and/or DSRC (dedicated short range communications) communication based on backend cloud messages to support the system. Some embodiments include a system and method for a virtual traffic management system to coordinate traffic light signal phase and timing control in a cloud based environment through cellular and DSRC communication by migrating the local traffic controller system to a centralized environment in a cloud-based backend system. This system can replace physical traffic light control modules located at the respective intersections using a purely software based virtual traffic light control service.

The Society of Automotive Engineers (SAE) J2735 standard in Dedicated Short Range Communications (DSRC) Message Set Dictionary defines the Signal Phase and Timing format that describes the current state of a traffic signal system and its phases corresponding to the specific lanes of the intersection. The SPaT information can be delivered through a cellular network and/or DSRC while a vehicle is approaching an intersection within a predetermined distance. Unlike SPaT information delivery through a cellular network in which network latency due to signal processing is a concern, DSRC communication minimizes latency and can be considered closer to real-time or immediate than cellular signals.

In addition to SPaT information, the SAE J2735 defines the map data format which describes the static physical geometry layout of one or more intersections and is used to convey many types of geographic road information. The MAP message is used along with SPaT information to describe an intersection and current state of control in support of DSRC messages. Currently, traffic agencies define a set of standard scheme based on signal phases. A traffic signal phase is a timing unit (green, yellow, and red clearance) that facilitates one or more movements at the same time. FIG. 4 illustrates a conventional 4-phase scheme for an intersection with four road segments coming together and no signal-controlled turn lanes and no pedestrian signals illustrated for ease of understanding.

FIG. 4 is a general illustration of an example embodiment of the present invention. As shown for intersection 200, each traffic light 210-240 is in communication with a traffic light controller 250 for the intersection. The traffic light controller may also be in communication with vehicle probes 260 approaching the intersection, such as via a wireless communication protocol. The signal phase and timing of the traffic lights of the intersection 200 can be communicated to the approaching vehicle probes 260, such as via communications interface 22. Messages from the traffic light controller 250 may be communicated to the vehicle probes 260 via a broadcast message or point-to-point communication. The traffic light controller 250 may be in communication, such as via network 30, with a traffic management system 35. The traffic light controller can receive signal phase and timing information for each traffic light of the intersection 200 from the traffic management system 35. Further, any additional light controls, such as pedestrian, emergency responders, etc. can be communicated to the traffic light controller 250 from the traffic management system 35. This information may be communicated to the traffic light controller 250 via a cloud backend system using a subscribe/publish service, for example. The traffic light controller 250 of some embodiments may provide vehicle probe data information, such as from vehicle probes 260, to the traffic management system 35 to provide real time updates of traffic flow or congestion at an intersection 200.

Traffic signals or traffic lights, and traffic signal or traffic light controllers, are referred to generally herein as traffic controllers. Certain embodiments described herein provide wireless communication to traffic controllers from a central traffic control operation to optimize signal phase and timing and cooperation of traffic signals at intersections within a road network geometry. Managing SPaT of traffic lights from a central operation may enable better control over traffic flow through an area, such as an urban or suburban region by having the traffic lights work in cooperation with one another. Proper identification of lanes approaching and departing an intersection may further enhance the ability to manage traffic signal controllers for traffic planning by maximizing throughput of intersections while minimizing traffic congestion and improving traffic efficiency (e.g., fuel efficiency of the traffic). This cooperative operation may increase traffic throughput while reducing fuel consumption and reducing driver irritation. Further, increased traffic throughput may reduce the perceived need for higher-capacity roadways (e.g., through additional lanes or bypass roads) and may lead to cost savings through optimization of existing roadways.

The status of the signal phase and the timing of the state transitions of a traffic light may be collected in real-time (e.g., through traffic controller 10 or mobile device 25), or predicted through engineering analysis. The signal phase may include the signal that is presented to a motorist, pedestrian, cyclist, etc., at an intersection. Traffic lights may include various phases. For example, a single-phase traffic light may include a flashing amber or red light indicating right-of-way at an intersection, or a green or red arrow to indicate a protected or prohibited turn. A dual-phase traffic light may include, for example, a pedestrian walk/don't walk signal. A three-phase traffic light may include a conventional green/amber/red traffic light. Some embodiments described herein may pertain to all traffic light phases and are not limited to the brief description of phases above. The state transitions may include transitions between phases at a traffic light. A traffic light changing from green to amber is a first state transition, while changing from amber to red is a second state transition. The collected signal phase and timing of the state transitions may be provided through communication protocols either directly to interested users, or through a distribution network shown in FIG. 1.

Systems of an example embodiment may identify intersections, such as in map database 110, and map-match vehicle probe data. The vehicle probe data may include trajectory and other information to facilitate traffic flow analysis of the vehicle probes as they traverse the road network geometry. Signal phase and timing for each intersection can be analyzed at the traffic management system 35, such as by processing sever 102, together with vehicle probe data from the vehicle probes traversing the road network. This analysis can establish where traffic congestion exists or may soon exist, such that traffic light signal phase and timing can be adjusted to accommodate the traffic and to mitigate any traffic congestion. A cloud message system, such as a publisher/subscriber type service may be used to communicate any revised signal phase and timing messages to each respective intersection. The road network geometry may include clusters of intersections, particularly those that lie along a particular route, and those clusters may be treated as a group in order to coordinate signal phase and timing to synchronize any changes for facilitating smooth traffic flow. The messages regarding signal phase and timing may be communicated in a variety of manners, such as through cellular signal (e.g., 3G, 4G LTE, etc.) or via DSRC system communications. Upon receipt of signal phase and timing information at a traffic light controller 250, the signal phase and timing may be provided to vehicles approaching the intersection 260 and/or pedestrians attempting to cross the intersection.

According to one embodiment, traffic light information may be communicated directly to vehicles (e.g., vis DSRC), such as to a navigation interface or an advanced driver assistance system. The traffic signal phase may be communicated to a driver through a user interface of the vehicle. This may enable a driver to be aware of a traffic signal phase before they reach an intersection (e.g., if the traffic light is over a hill, around a bend, or obscured by a vehicle or tree) without having a line-of-sight to the traffic light. Further, if a traffic signal has failed due to lack of power, such as during a storm, the traffic signal phase may still be communicated from a central controller of the road network geometry, and may be seen through in-vehicle user interfaces to enable the traffic at the intersection to function normally. Such an embodiment may concievably allow traffic lights to be eliminated and replaced entirely by in-vehicle displays of traffic signal phases of intersections.

FIG. 5 illustrates an example embodiment of a cloud based system for signal phase and timing analysis in order to deliver signal phase and timing information to traffic light controllers. The diagram of FIG. 5 may be implemented by, for example, traffic management system 35 of FIG. 3. The processing server 102 may receive or retrieve the map data describing the road network geometry as shown at 310. Probe and sensor data may be received at 320, such as by probe data points from around the road network geometry. The traffic processing engine 330, which may be embodied by processing server 102, may receive this information and evaluate road network traffic at 340 to determine issues relating to traffic flow and efficiency of traffic throughput through the network. Based on this evaluation, traffic light signal phase and timing (SPaT) analysis may be conducted at 350 to determine at what intersections and which traffic lights thereof require signal phase and timing adjustment. This analysis may also involve machine learning or deep learning where traffic volumes and congestion may be evaluated relative to one or more epochs to establish a timeframe (day of week, time of day, season of year, etc.) in which certain intersections or clusters of intersections experience traffic congestion. This machine learning or deep learning may enable predictive signal phase and timing adjustment through a proactive approach rather than waiting for traffic congestion to begin before signal phase and timing changes are made.

Once the signal phase and timing analysis has been completed, either in a proactive or reactive manner, the signal phase and timing including any necessary adjustments or changes may be cascaded to the traffic light controllers 370. As shown in FIG. 5, the signal phase and timing information may be sent to access points 360 and sent wirelessly to the traffic light controllers 370.

Further optimization of an example embodiment described herein for analyzing and adjusting signal phase and timing of traffic lights may be performed. For example, the current traffic state for a road network geometry may be monitored and traffic upstream of an intersection may be analyzed to determine the traffic likely to be seen at an intersection downstream of the currently monitored traffic. This enables the traffic management system 35 to evaluate anticipated traffic and respond proactively with signal phase and timing adjustments as needed. This analysis can be performed in real time and/or using historical probe data. Hybrid analysis can be used to include both real time probe data and historical probe data, where comparisons can be made between the real time probe data to establish if it is consistent with previously experienced historical probe data, such that prior traffic experiences can inform future traffic scenarios and adjust the signal phase and timing of associated intersections proactively before traffic congestion begins.

Signal phase and timing analysis as described herein can use machine learning to generate predictive signal phase and timing strategies for a road network geometry. For example, analysis of traffic patterns may be conducted over a period of time, where various epochs are established. An epoch includes a temporal parameter that may include a time of day, day of week, season of year, or special event (e.g., a sporting event or concert). The traffic patterns may be parsed according to an epoch associated with the traffic patterns, such as heavy traffic in one direction during a weekday morning rush hour epoch. A weekday afternoon rush hour epoch may have heavy traffic flow in the opposite direction of the morning rush hour epoch. The signal phase and timing strategy may differ between the weekday morning rush hour epoch and the weekday afternoon rush hour epoch by prioritizing traffic flow along routes in the direction of heavy traffic volumes, even ahead of the traffic accumulating. This signal phase and timing adjustment may include longer periods of green lights in the direction of heavy or anticipated-to-be-heavy traffic flow to mitigate congestion.

Traffic congestion can be influenced by environmental factors beyond traffic volumes and traffic light signal phase and timing. For example, adverse weather can influence traffic congestion and create traffic scenarios that may diverge from traffic scenarios experienced during pleasant weather. Vehicle probe data may include sensor data that can provide an indication of adverse weather conditions at a local level relative to the vehicle. For example, if it is determined through vehicle probe sensor data that a vehicle's windshield wipers are on and operating at a relatively high speed (e.g., continuous operation as opposed to intermittent operation), it may be established that the vehicle is driving through rain. This analysis may be supported or dismissed based on vehicle probe sensor data from neighboring vehicles to provide a more robust estimation of adverse weather conditions.

In response to establishing that adverse weather exists, such as through the detection of high speed windshield wiper use (continuous use), traffic light signal phase and timing may be adjusted accordingly. Through machine learning it may be determined that under certain weather conditions, certain intersections or traffic lights thereof may experience abnormal traffic volumes. In such a circumstance, the traffic light signal phase and timing may be adjusted responsive to the indication that adverse weather exists proximate the intersection. Further, in adverse weather conditions, traffic light signal phase and timing may be adjusted to provide greater safety buffer times between traffic light phases to help avoid accidents at the intersections. For example, during rain a traffic light may change from having a one-second period when all four directions of the intersection are red lights to a three-second period when all four directions of the intersection are red lights.

Adverse weather conditions may also be established through other vehicle probe sensor data, such as traction control events of a vehicle where traction control is activated due to wheel spin conditions of the vehicles. Such sensor data may indicate that the roadways are wet or slippery (e.g., due to ice or snow), and traffic light signal phase and timing may be adjusted accordingly. Further, evaluation of weather station radar may facilitate traffic light signal phase and timing planning if the radar data provides an indication of adverse weather.

Additional factors that can influence signal phase and timing of traffic lights may include emergency vehicle traffic. For example, if an ambulance is responding to a call and traveling to a specific destination under emergency conditions, the route to reach that specific destination may be established by a navigation system. This route may be established by traffic management system (e.g., using processing server 102) based on traffic volumes and travel time, or by a navigation system associated with the ambulance. The route to the destination may be communicated to the traffic management system 35, which may track the probe data from the ambulance, and adjust signal phase and timing of traffic lights at intersections along the route through communication from the traffic management system 35 to the respective traffic controllers 10. This may enable traffic lights to change in advance of the ambulance's arrival at the intersection to enable smooth traffic flow and expedite the ambulance along the route to the destination.

FIGS. 5 and 6 are flowcharts illustrative of a system, method, and program product according to an example embodiment of the invention. The flowchart operations may be performed by a computing device, such as apparatus 20 of FIG. 2, operating over a communications network, such as that shown in FIG. 1. It will be understood that each block of the flowcharts and combinations of blocks in the flowcharts may be implemented by various means, such as hardware, firmware, processor, circuitry, and/or other device associated with execution of software including one or more computer program instructions. For example, one or more procedures described above may be embodied by computer program instructions. In this regard, the computer program instructions which embody the procedures described above may be stored by a memory device of an apparatus employing an embodiment of the present invention and executed by a processor in the apparatus. As will be appreciated, any such computer program instructions may be loaded onto a computer or other programmable apparatus (e.g., hardware), such as depicted in FIG. 2, to produce a machine, such that the resulting computer or other programmable apparatus embody means for implementing the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowcharts support combinations of means for performing the specified functions, combinations of operations for performing the specified functions and program instruction means for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

An example embodiment of the methods described herein for signal phase and timing for traffic lights communicated from a central traffic management system. Map data including road network geometry and traffic light locations relative to intersections of the road network geometry may be received at 410. These may be stored, for example, in map database 110 of the traffic management system 35. Signal phase and timing of traffic lights at the traffic light locations may be received at 420 such that traffic patterns may be established relative to the signal phase and timing and the epoch. At 430, probe and sensor data may be received from a plurality of probes traversing the road network geometry. The received probe and sensor data may be analyzed at 440 relative to the road network geometry and the traffic light locations. A revised signal phase and timing for at least one traffic light within the road network geometry may be determined at 450 based on the analyzed probe and sensor data relative to the road network geometry and the traffic light locations. The revised signal phase and timing may be provided to the at least one traffic light, such as via the associated traffic controller, within the road network geometry at 460.

In an example embodiment, an apparatus for performing the method of FIGS. 5 and 6 above may comprise a processor (e.g., the processor 24) configured to perform some or each of the operations (310-370 and/or 410-460) described above. The processor may, for example, be configured to perform the operations (310-370 and/or 410-460) by performing hardware implemented logical functions, executing stored instructions, or executing algorithms for performing each of the operations. Alternatively, the apparatus may comprise means for performing each of the operations described above. In this regard, according to an example embodiment, examples of means for performing operations 310-370 and/or 410-460 may comprise, for example, the processor 24 and/or a device or circuit for executing instructions or executing an algorithm for processing information as described above.

As described above and as will be appreciated by one skilled in the art, certain embodiments of the present invention may be configured as a system, method or electronic device. Accordingly, some embodiments of the present invention may be comprised of various means including entirely of hardware or any combination of software and hardware. Furthermore, embodiments of the present invention may take the form of a computer program product on a computer-readable storage medium having computer-readable program instructions (e.g., computer software) embodied in the storage medium. Any suitable computer-readable storage medium may be utilized including hard disks, CD-ROMs, optical storage devices, or magnetic storage devices.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A traffic control system comprising:

a memory comprising map data having road network geometry and traffic light locations relative to intersections of the road network geometry; and processing circuitry configured to:

receive signal phase and timing of traffic lights at the traffic light locations;

receive probe and sensor data from a plurality of probes traversing the road network geometry for a plurality of past epochs;

analyze the received probe and sensor data from the plurality of probes for the plurality of past epochs relative to the road network geometry and the traffic light locations;

determine an epoch specific revised signal phase and timing for at least one traffic light within the road network geometry for a future epoch based on the analyzed probe and sensor data for the plurality of past epochs relative to the road network geometry and the traffic light locations;

provide the epoch specific revised signal phase and timing to the at least one traffic light within the road network geometry; and cause the at least one traffic light to be controlled using the epoch specific revised signal phase and timing in response to the future epoch becoming a present epoch.

2. The traffic control system of claim 1, wherein each traffic light is associated with a traffic light controller, and wherein processing circuitry configured to provide revised signal phase and timing to the at least one traffic light comprises processing circuitry configured to send a revised signal phase and timing message to the respective traffic light controller.

3. The traffic control system of claim 1, wherein the processing circuitry configured to analyze the received probe and sensor data from the plurality of probes relative to the road network geometry and the traffic light locations comprises processing circuitry configured to:

analyze probe and sensor data approaching an intersection; and determine revised signal phase and timing for a traffic light associated with the intersection based on the probe and sensor data approaching the intersection.

4. The traffic control system of claim 1, wherein the processing circuitry configured to analyze the received probe and sensor data from the plurality of probes relative to the road network geometry and the traffic light locations comprises processing circuitry configured to:

determine sensor data from probe and sensor data proximate an intersection indicates a windshield wiper rate; and determine revised signal phase and timing for at least one traffic light associated with the intersection based, at least in part, on the windshield wiper rate.

5. The traffic control system of claim 4, wherein the revised signal phase and timing for the at least one traffic light associated with the intersection includes incorporating a safety buffer in the revised signal phase and timing to account for diminished reaction times.

6. The traffic control system of claim 1, wherein the processing circuitry configured to analyze the received probe and sensor data from the plurality of probes relative to the road network geometry and the traffic light locations comprises processing circuitry configured to:

determine sensor data from probe and sensor data proximate an intersection indicates a traction control event; and determine revised signal phase and timing for at least one traffic light associated with the intersection based, at least in part, on the traction control event.

7. The traffic control system of claim 1, wherein the processing circuitry configured to cause the at least one traffic light to be controlled using the revised signal phase and timing comprises causing the at least one traffic light to be controlled remotely from a central location from which a plurality of traffic lights at a plurality of intersections of the road network geometry are controlled.

8. An apparatus comprising at least one processor and at least one memory including computer program code, the at least one memory and the computer program code configured to, with the at least one processor, cause the apparatus to at least perform:

receive map data including road network geometry and traffic light locations relative to intersections of the road network geometry;

receive signal phase and timing of traffic lights at the traffic light locations;

receive probe and sensor data from a plurality of probes traversing the road network geometry for a plurality of past epochs;

analyze the received probe and sensor data from the plurality of probes for the plurality of past epochs relative to the road network geometry and the traffic light locations;

determine an epoch specific revised signal phase and timing for at least one traffic light within the road network geometry for a future epoch based on the analyzed probe and sensor data relative to the road network geometry and the traffic light locations; and provide the epoch specific revised signal phase and timing to the at least one traffic light within the road network geometry.

9. The apparatus of claim 8, wherein each traffic light is associated with a traffic light controller, and wherein causing the apparatus to provide revised signal phase and timing to the at least one traffic light comprises sending a revised signal phase and timing message to the traffic light controller.

10. The apparatus of claim 8, wherein causing the apparatus to analyze the received probe and sensor data from the plurality of probes relative to the road network geometry and the traffic light locations comprises causing the apparatus to:

analyze probe and sensor data approaching an intersection; and determine revised signal phase and timing for a traffic light associated with the intersection based on the probe and sensor data approaching the intersection.

11. The apparatus of claim 8, wherein causing the apparatus to analyze the received probe and sensor data from the plurality of probes relative to the road network geometry and the traffic light locations comprises causing the apparatus to:

determine sensor data from probe and sensor data proximate an intersection indicates a windshield wiper rate; and determine revised signal phase and timing for at least one traffic light associated with the intersection based, at least in part, on the windshield wiper rate.

12. The apparatus of claim 11, wherein the revised signal phase and timing for the at least one traffic light associated with the intersection includes incorporating a safety buffer in the revised signal phase and timing to account for diminished reaction times.

13. The apparatus of claim 8, wherein causing the apparatus to analyze the received probe and sensor data from the plurality of probes relative to the road network geometry and the traffic light locations comprises causing the apparatus to:

determine sensor data from probe and sensor data proximate an intersection indicates a traction control event; and determine revised signal phase and timing for at least one traffic light associated with the intersection based, at least in part, on the traction control event.

14. The apparatus of claim 8, wherein causing the apparatus to provide revised signal phase and timing to the at least one traffic light within the road network geometry comprises causing the apparatus to cause the at least one traffic light to be controlled remotely from a central location from which a plurality of traffic lights at a plurality of intersections of the road network geometry are controlled.

15. A computer program product comprising at least one non-transitory computer-readable storage medium having computer-executable program code instructions stored therein, the computer-executable program code instructions comprising program code instructions to:

receive map data including road network geometry and traffic light locations relative to intersections of the road network geometry;

receive signal phase and timing of traffic lights at the traffic light locations;

receive probe and sensor data from a plurality of probes traversing the road network geometry for a plurality of past epochs;

analyze the received probe and sensor data from the plurality of probes for the plurality of past epochs relative to the road network geometry and the traffic light locations;

determine an epoch specific revised signal phase and timing for at least one traffic light within the road network geometry for a future epoch based on the analyzed probe and sensor data for the plurality of past epochs relative to the road network geometry and the traffic light locations; and provide the epoch specific revised signal phase and timing to the at least one traffic light within the road network geometry.

16. The computer program product of claim 15, wherein each traffic light is associated with a traffic light controller, and wherein the program code instructions to provide revised signal phase and timing to the at least one traffic light comprise program code instructions to send a revised signal phase and timing message to the traffic light controller.

17. The computer program product of claim 15, wherein the program code instructions to analyze the received probe and sensor data from the plurality of probes relative to the road network geometry and the traffic light locations comprise program code instructions to:

analyze probe and sensor data approaching an intersection; and determine revised signal phase and timing for a traffic light associated with the intersection based on the probe and sensor data approaching the intersection.

18. The computer program product of claim 15, wherein the program code instructions to analyze the received probe and sensor data from the plurality of probes relative to the road network geometry and the traffic light locations comprise program code instructions to:

determine sensor data from probe and sensor data proximate an intersection indicates a windshield wiper rate; and determine revised signal phase and timing for at least one traffic light associated with the intersection based, at least in part, on the windshield wiper rate.

19. The computer program product of claim 18, wherein the revised signal phase and timing for the at least one traffic light associated with the intersection includes incorporating a safety buffer in the revised signal phase and timing to account for diminished reaction times.

20. The computer program product of claim 15, wherein the program code instructions to analyze the received probe and sensor data from the plurality of probes relative to the road network geometry and the traffic light locations comprise program code instructions to:

determine sensor data from probe and sensor data proximate an intersection indicates a traction control event; and determine revised signal phase and timing for at least one traffic light associated with the intersection based, at least in part, on the traction control event.

21. The computer program product of claim 15, wherein the program code instructions configured to provide revised signal phase and timing to the at least one traffic light within the road network geometry comprises program code instructions to cause the at least one traffic light to be controlled remotely from a central location from which a plurality of traffic lights at a plurality of intersections of the road network geometry are controlled.

22. A method comprising:

receiving map data including road network geometry and traffic light locations relative to intersections of the road network geometry;

receiving signal phase and timing of traffic lights at the traffic light locations;

receiving probe and sensor data from a plurality of probes traversing the road network geometry for a plurality of past epochs;

analyzing the received probe and sensor data from the plurality of probes for the plurality of past epochs relative to the road network geometry and the traffic light locations;

determining an epoch specific revised signal phase and timing for at least one traffic light within the road network geometry for a future epoch based on the analyzed probe and sensor data relative to the road network geometry and the traffic light locations; and providing the epoch specific revised signal phase and timing to the at least one traffic light within the road network geometry.

23. The method of claim 22, wherein each traffic light is associated with a traffic light controller, and wherein providing revised signal phase and timing to the at least one traffic light comprises sending a revised signal phase and timing message to the traffic light controller.

* * * * *